US008070450B1

(12) United States Patent
Ryznic et al.

(10) Patent No.: US 8,070,450 B1
(45) **Date of Patent: *Dec. 6, 2011**

(54) HIGH TEMPERATURE TURBINE ROTOR BLADE

(75) Inventors: John E Ryznic, Palm Beach Gardens, FL (US); Wesley D Brown, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 341 days.

This patent is subject to a terminal disclaimer.

(21) Appl. No.: 12/426,343

(22) Filed: Apr. 20, 2009

(51) Int. Cl.
*F01D 5/18* (2006.01)

(52) U.S. Cl. ..... 416/224; 416/226; 416/229 A; 416/233

(58) Field of Classification Search ..... 416/223 R, 416/224, 226, 227 R, 232, 233, 229 R, 241 A, 416/241 B
See application file for complete search history.

(56) References Cited

U.S. PATENT DOCUMENTS 4,010,531 A * 3/1977 Andersen et al. ..... 29/889.721
4,136,516 A * 1/1979 Corsmeier ..... 60/39.091
4,971,641 A * 11/1990 Nelson et al. ..... 156/64
5,129,787 A * 7/1992 Violette et al. ..... 416/226
5,240,376 A * 8/1993 Velicki ..... 416/229 A
5,314,309 A * 5/1994 Blakeley et al. ..... 416/226
6,139,278 A * 10/2000 Mowbray et al. ..... 416/229 A
6,224,339 B1 * 5/2001 Rhodes et al. ..... 416/224
6,305,905 B1 * 10/2001 Nagle et al. ..... 416/204 R
6,533,547 B2 * 3/2003 Anding et al. ..... 416/97 R
6,726,444 B2 * 4/2004 Zhao et al. ..... 415/115
7,125,225 B2 * 10/2006 Surace et al. ..... 416/96 R
7,258,528 B2 * 8/2007 Trindade et al. ..... 416/96 A
7,303,376 B2 * 12/2007 Liang ..... 416/96 R
7,311,497 B2 * 12/2007 Sharma et al. ..... 416/97 A
7,497,655 B1 * 3/2009 Liang ..... 415/1
7,549,844 B2 * 6/2009 Liang ..... 416/97 R

* cited by examiner

*Primary Examiner* — Michael Lebentritt
(74) *Attorney, Agent, or Firm* — John Ryznic

(57) ABSTRACT

A turbine rotor blade made from the spar and shell construction in which the shell formed from a plurality of shell segments each being a thin wall shell segment made from a high temperature resistant material that is formed by a wire EDM process, and where the shell segments are each secured to the spar separately using a retainer that is poured into retainer occupying spaces formed in the shell segments and the spar, and then hardened to form a rigid retainer to secure each shell segment to the spar individually. The spar includes a number of radial extending projections each with a row of cavities that form the retainer occupying spaces in order to spread the loads around. The retainer can be a bicast material, a transient liquid phase bonding material, or a sintered metal. An old shell can be easily removed and replaced with a new shell by removing parts of the retainer and re-pouring a new retainer with a new shell in place.

16 Claims, 3 Drawing Sheets

HIGH TEMPERATURE TURBINE ROTOR BLADE

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade made from a spar and shell construction.

2. Description of the Related Art Including Information Disclosed Under 37 CFR 1.97 and 1.98

A gas turbine engine, such as an industrial gas turbine (IGT) engine, passes a hot gas flow through a turbine having a number of stages or rows of rotor blades and stator vanes to extract energy and drive the rotor shaft to produce electric power. It is well known that the efficiency of the engine can be increased by passing a higher temperature gas through the turbine. However, the maximum temperature is related to the material properties and the cooling capability of the first stages blades and vanes.

Prior art turbine airfoils are produced from high temperature resistant materials such as Inconnel and other nickel based super-alloys in which the airfoils are cast using the well known investment casting process. These materials have relatively high temperature resistance. However, a thin walled airfoil cannot be produced using the investment casting process because the airfoil wall is too thin for casting of the alloy may not be castable at all. A thin walled airfoil would be ideal for improved cooling capability since the heat transfer rate through the thin wall would be extremely high. In a thin walled airfoil, the outer airfoil surface temperature would be about the same as the inner airfoil wall temperature because of the high heat transfer rate.

Exotic high temperature resistant materials such as Tungsten, Molybdenum and Columbium have higher melting temperature than the nickel based super-alloys currently used in turbine airfoils. However, tungsten and molybdenum cannot be cast because of their high melting temperatures, and especially cannot be cast into a thin wall airfoil because the material cannot flow within the small space formed within the mold.

Rotor blades must be replaced or repaired on a regular basis in order to maintain high levels of efficiency in the operation of an engine like the IGT engine used for electrical power generation. Thus, it would be beneficial to provide for a rotor blade that will allow for quick and easy replacement of any damaged or worn part of the blade so that the new blade can be installed. Also, it would be beneficial for the blade to be easily refurbished or brought back to like new condition without having to machine or weld or use other metal working processes to fix the blade.

One major problem with a spar and shell rotor blade design is the high stress loads applied to the spar that must support the shell during rotation of the blade. the shell, if made from a relatively heavy material, will produce higher centrifugal loads on the spar. The problem of creep buckling could lead to shorter life for the shell due to high compressive loads that occur on the shell due to the high centrifugal loads. Creep buckling occurs when the shell wall is continuously placed under compression due to the centrifugal loads from rotation of the blade. the shell walls can actually buckle due to high centrifugal loads over long periods of time.

Thus, a new and improved turbine blade has been proposed in which a high temperature resistant exotic material such as tungsten or molybdenum is used to form a thin walled shell for the airfoil that is secured to a spar that forms a rigid support structure for the shell. The shell is formed from tungsten or molybdenum using an EDM (electric discharge machining) process such as wire EDM to cut the metallic material into the shell shape. The shell in then secured to the spar to form a turbine blade or vane which can be used under much higher operating temperatures than the investment cast nickel super-alloy blade or vane.

BRIEF SUMMARY OF THE INVENTION

It is an object of the present invention to provide for a spar and shell constructed turbine rotor blade in which the problem of creep buckling is eliminated.

It is another object of the present invention to provide for a spar and shell turbine rotor blade in which the shell is supported along the spar at a number of positions along the blade spanwise direction.

The above objectives and more are achieved with the turbine rotor blade of the present invention which includes a spar and shell construction in which the spar extends from the root and platform section of the blade to form a single piece, the shell is formed of a number of shell sections, and the shell sections are secured to the spar at separate locations along the spar to form the blade assembly, and where the shell sections are each secured to the spar with the use of a series of bicast locks or retainers that hold the shell sections to the spar and transmit the radial loads along the length of the spar to more evenly distribute the centrifugal loads. The bicast locks are poured into a cavity that is formed when the shell is positioned over the spar, and the bicast lock is brazed to the cavity surfaces to form a rigid retainer.

To remove a damaged shell from the blade assembly, the bicast retainers are easily removed so that the old shell can be removed and a new shell can be reinserted onto the spar. The cavity formed is then poured with the retainer material to create a new bicast lock to secure the new shell to the old spar. In another embodiment, the retainer or lock can include a TLP (transient liquid phase) powder with Boron that is then brazed to form the rigid lock or retainer. In another embodiment, a "stop-off" agent can be used on the spar side cavity to prevent the bicast material from bonding to the spar so that the bicast material can be more easily removed from the re-usable spar when the shell is to be replaced. In still another embodiment, the retainer can be formed from a sintered metal.

DETAILED DESCRIPTION OF THE INVENTION

Figure 2:
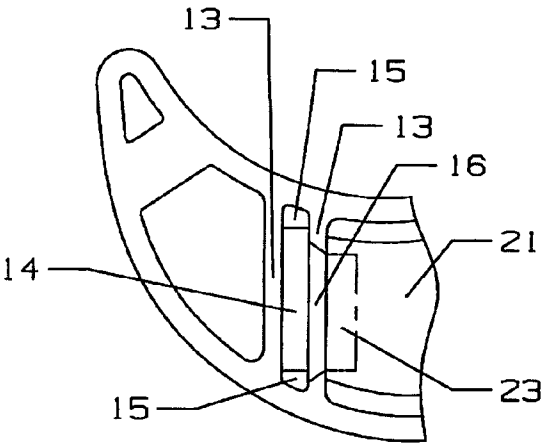
FIG. 2 shows a cross section view of a close-up view of the leading edge section of the FIG. 1 blade.

The spar and shell rotor blade of the present invention is for use in an industrial gas turbine engine in the first or second stage of the turbine. These blades are much larger than those used in as aero engine and therefore the weight of the shell would be an important design factor in the blade assembly. However, the bicast spar and shell rotor blade can be used in an aero engine. The turbine rotor blade is made with a spar that extends from a platform and root section all formed as a single piece or that can be formed as multiple pieces, and with a shell secured to the spar to form the airfoil portion of the blade. A tip cap can be secured to the spar tip end to form the blade tip for the blade assembly.

The shell is formed using a wire EDM process with the shell made from a high temperature exotic material that can withstand higher temperatures than the prior art turbine blades made from the investment casting process. The preferred metallic material for the present invention is Molybdenum because of the high strength capability and high temperature resistance. Tungsten is considered for use in a rotor blade, but because tungsten is very dense compared to Molybdenum it is not useful for a rotor blade because of the high centrifugal loads applied to the spar to retain the much heavier tungsten shell to the spar. Tungsten would be good for a spar and shell stator vane which does not rotate. Columbium or niobium is also considered for use as the shell material for a rotor blade.

The rotor blade with the spar and shell construction of the present invention includes a shell having an airfoil cross sectional shape with a leading edge and a trailing edge and with a pressure side wall 12 and a suction side wall 11 extending between the two edges. the shell is formed from a number of shell segments such that a complete shell assembly is formed when the shell segments are stacked in a radial or blade spanwise direction. In the first embodiment, the shell assembly is formed from four shell segments each having substantially the same spanwise height. The shell also includes ribs 13 that extend between the two walls to provide added support for the shell. Each shell segment includes the rib or ribs that extend across from the pressure side wall 12 to the suction side wall 11 and form part of the shell to spar retainer to be described below. The shell ribs 13 form adjacent pairs with an opening 14 between adjacent ribs 13 that form a passage for the insertion or pouring of a material that forms the retainer described later. The ribs 13 that face a cavity 23 formed within the spar includes an opening 16 for the retainers also described below. In this embodiment, three sets of ribs 13 each having two adjacent ribs is used to form a retainer with two sections of the spar.

Figure 1:
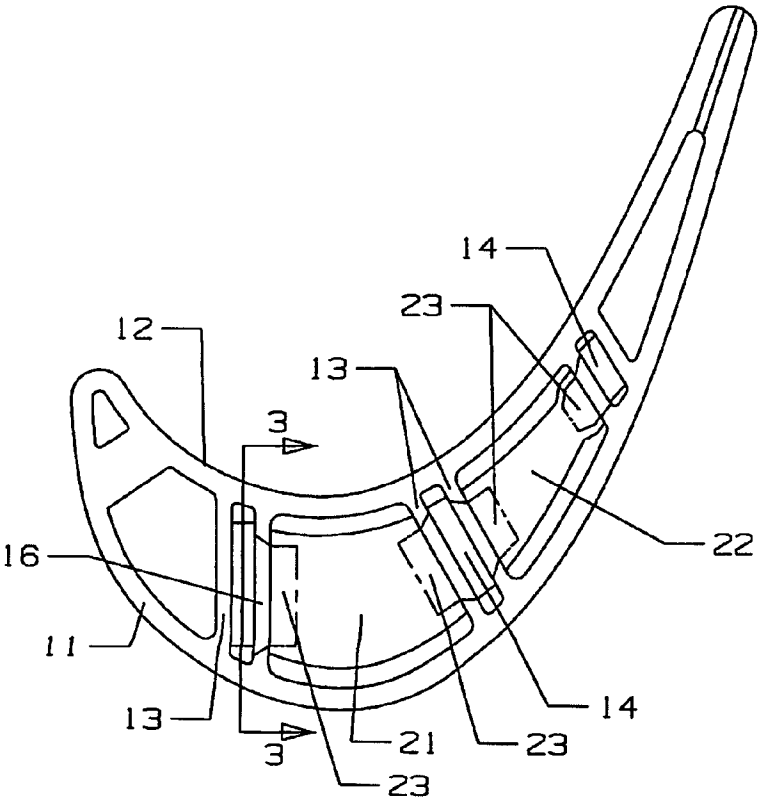
FIG. 1 shows a cut-away view of a first embodiment of the spar and shell blade of the present invention.
Figure 5:
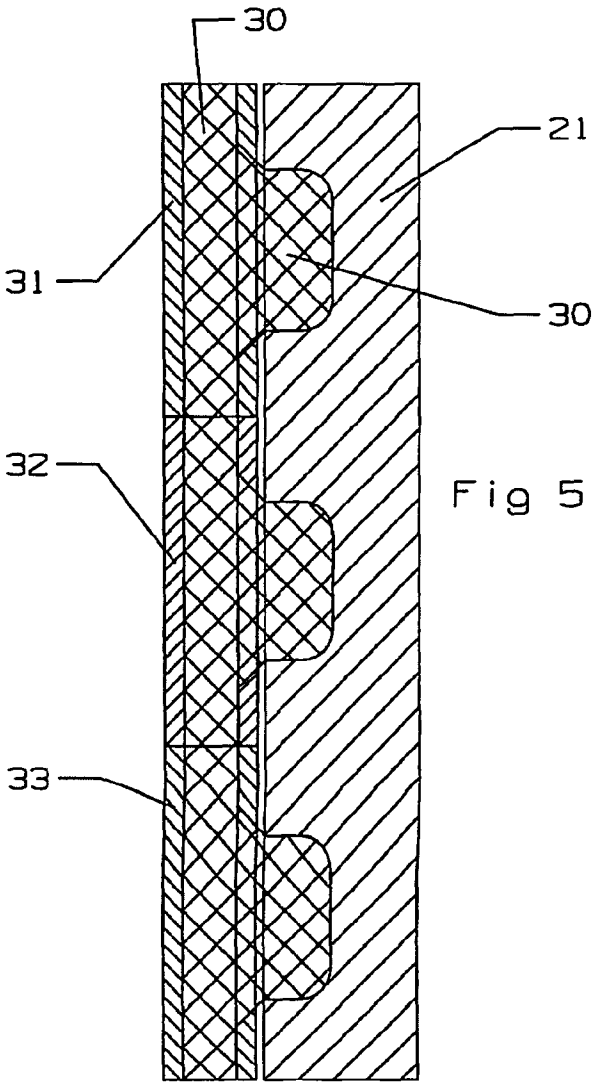
FIG. 5 shows a cross section view of the cavity in FIG. 4 filled with a bicast material to form the retainer between the spar and the shell.

The spar includes two radial extending projections 21 that form locking surfaces to the shell. The spar includes a forward radial extending projection and an aft radial extending projection 22. In other embodiments, more than two radial extending projections can be used for the spar. The radial extending projections 21 and 22 have cavities 23 that face the sets of ribs 13 formed in the shell as seen in FIG. 1. In this embodiment, the forward set of shell ribs 13 is associated with only one spar cavity 23, the aft set of shell ribs 13 is associated with one spar cavity 23, and the middle set of shell ribs 13 is associated with two spar cavities 23. the spar cavities 232 form retainer occupying spaces.

Figure 3:
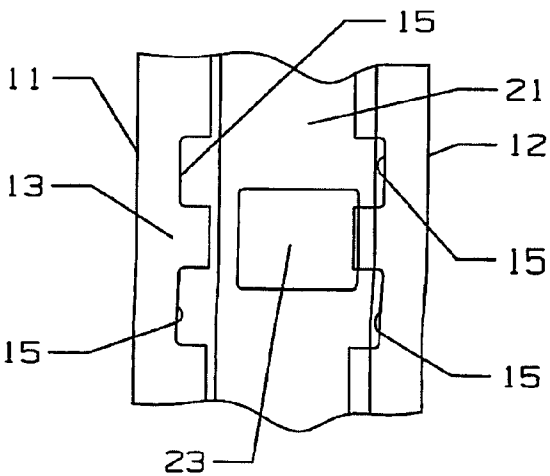
FIG. 3 shows a cross section view a cavity formed within the spar from the side view.

The shell ribs 13 also include openings 15 formed on the sides that face toward the center of the opening 14 as seen in FIG. 3. These openings 15 are on both sides of the ribs along the pressure side wall 12 and the suction side wall 11, and the openings 15 face the opposite wall of the airfoil. These openings 15 function as retainer occupying surfaces for the bicast material poured into the opening 14 between adjacent ribs 13. The spar cavities 23 and the shell openings 15 together form the retainer occupying spaces in which a liquid or powdered material is poured into and then hardened to form a rigid retainer to secure the shell to the spar. As seen in FIG. 3, a number of openings 15 in the ribs 13 can be associated with a single spar cavity 23. since the retainer is one piece that extends along most of the shell spanwise (radial) length, the openings 15 in the ribs 13 can extend the entire length of the shell 12. The number of openings 15 would depend upon the amount of retaining force the shell could provide to limit the stress level due to the shell wanting to pull away from the spar in the spanwise direction from the centrifugal loads.

Figure 4:
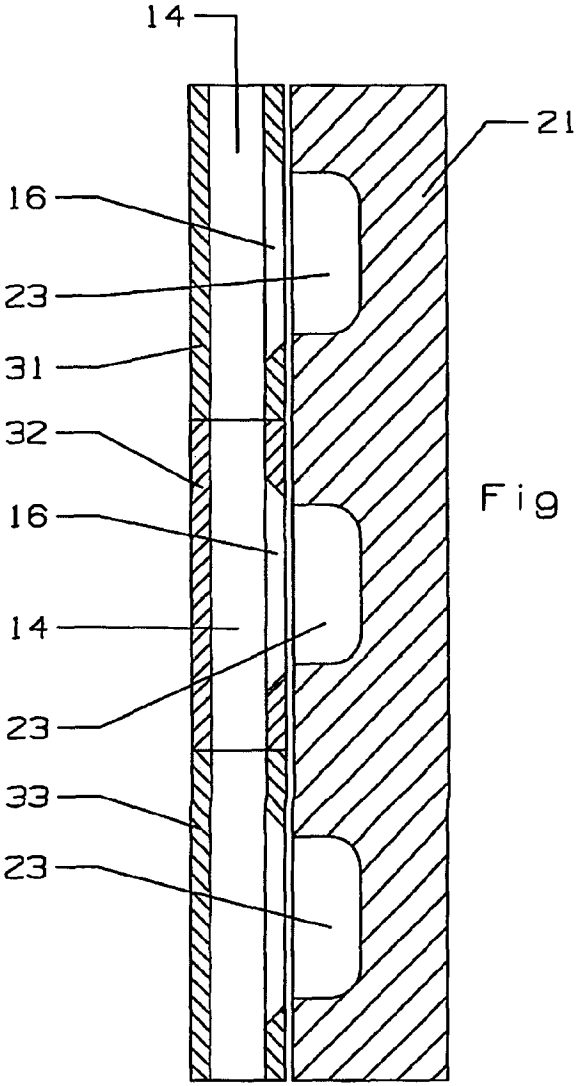
FIG. 4 shows a cross section view of the cavity formed between the spar and the shell that is filled with a bicast material to form the retainer.

FIG. 4 shows best the spar and shell features that form the retainer between them when a material is poured into the cavities and solidified to form a lock between the shell and the spar. The shell assembly is formed from a number of shell segments with three segments (31, 32 and 33) shown in FIG. 4. Each shell segment 31-33 has substantially the same radial or spanwise height. Each shell segment 31-33 includes one or more ribs that extend across from the walls to form the retainer surface for the bicast retainer to secure the shell segments to the spar. The shell ribs 13 formed the passage 14 that extends in a radial direction of the blade. The rib openings 16 are shown located across from the spar cavities 23 so allow for the bicast material to pour into the cavity 23.

To retain the shell segments to the spar, the shell segments are positioned over the spar with the two radial extending projections 21 and 22 extending into the two spaces formed between the three sets of shell ribs 13 as seen in FIG. 1. When the shell segments are properly positioned with respect to the spar, the shell rib openings 16 are aligned with the spar cavities 23 as seen in FIG. 4. each shell segment includes an opening adjacent to a spar cavity 23 so that each shell segment can be secured to the spar individually. A locking material is poured into the shell rib space 14 from the top of the shell so that the material will flow into the spar cavities 23. When the material fully occupies the spaces and cavities, the material is hardened to form a solid and rigid lock or retainer to retain the shell to the spar. The multiple radial extending projections on the spar and the series of cavities 23 that extend along the spanwise or radial direction of the shell provide a number of retaining locations that function to spread out the load between the shell and the spar. Each shell segment is thus individually secured to the spar so that a shell segment located below one shell segment will not transfer centrifugal load to the shell segments located above in the blade radial direction that can lead to creep buckling of the shell. Because the blade rotates within the turbine of the engine, a very large radial load is applied to the spar due to centrifugal forces acting on the shell. Without enough surface area to retain the shell, the stress level would be too high to be useful in a rotor blade. In the embodiment of the present invention, for an IGT engine rotor blade, four radial cavities are used that extend from the platform area to the blade tip along the spar radial extending projections. In other embodiments, one or more radial cavities can be used depending upon the loading that the spar must receive from the shell pulling away due to centrifugal loads.

The material used to pour into the spaces and cavities can be a bicast material, or a TLP (transient liquid phase) material such as a metal powder with Boron that is brazed to the metallic shell and spar surfaces. Also useful would be a "stop-off" agent placed on the surfaces of the spar so that when the old shell is removed the retainer will not stick to the spar so it can be easily removed. The metal powder that forms the retainer will not bond to the "stop-off" agent. Also useful as the retaining material is a sintered metal. In another embodiment, the retainer could be formed from a sintered metal.

With this design, the shell loads are transferred to the ribs, and then sheared into the spar thru the bicast material. This provides for a spar and shell rotor blade with a large load capability. The shell is well supported thru the three sets of shell ribs so that the radial load from the shell reacts into the spar at multiple radial locations. In other embodiments, the cavities could be formed in one rib or five ribs or even not in the ribs at all but in the shell wall to the spar. The bicast shear lugs can handle large shell loads with a pull of around 42,000 pounds force. This spar and shell design makes for a low coast rotor blade that is more easily repairable than the prior art rotor blades, eliminates the high tolerance problems with prior art spar and shell rotor blades, and eliminates the need for complex machining to assemble or repair a rotor blade.

Figure 6:
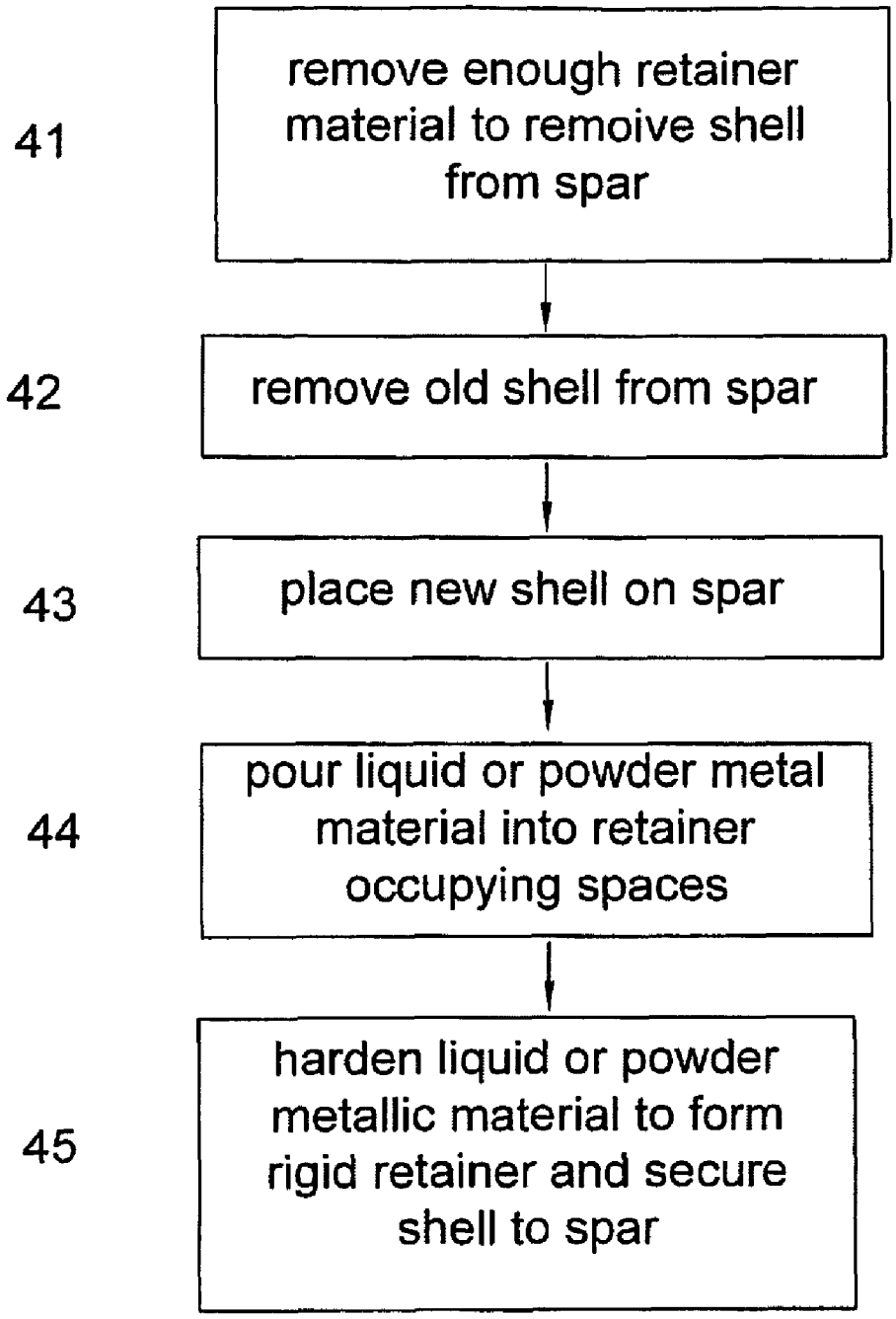
FIG. 6 shows process steps for replacing a shell of the rotor blade.

The rotor blade of the spar and shell construction with the poured retainer allows for a worn or damaged shell to be more easily replaced that prior art blades. FIG. 6 shows the process for performing this. The shell is removed from the spar by removing a portion of the retainer material 41 from the radial opening between the adjacent ribs in the shell so that the shell can be removed from the spar 42. With the shell removed, the remaining retainer material can be removed from the cavities in the spar. If the stop-off coating is used, then the retainer material will slide right out from the cavities since no bond was formed. All retainer material is removed and a new shell is placed over the spar 43. The retainer material is then poured into the opening between the adjacent ribs to fill the spar cavities 44. The retainer material is then hardened 45 using one of the above described processes to form a rigid retainer to lock the shell to the spar.

We claim:

1. A turbine rotor blade for a gas turbine engine comprising:

a spar having a radial extending projection with a cavity opening onto a surface of the radial extending projection, the cavity forming a retainer occupying space;

a shell having an airfoil cross sectional shape with a pressure side wall and a suction side wall;

the shell being formed from a plurality of shell segments;

the shell segments each including a retainer occupying space;

a rigid retainer formed within the retainer occupying spaces of the spar and the shell segments to secure the shell segments to the spar; and, the retainer being poured into place as a non-rigid material and hardened into a rigid material to form the retainer.

2. The turbine rotor blade of claim 1, and further comprising:

the radial extending projection includes a row of cavities extending along a spanwise direction of the blade;

the shell segments each includes a shell segment retainer securing surface for each spar cavity; and, the retainer occupies a space formed by the cavities and the shell segment securing surfaces.

3. The turbine rotor blade of claim 2, and further comprising:

the shell segments each includes a pair of adjacent ribs extending from the pressure side wall to the suction side wall;

the pair of ribs forming a radial extending passage for pouring the retainer material into the spar cavities.

4. The turbine rotor blade of claim 3, and further comprising:

the pair of adjacent ribs includes openings near the airfoil walls that face inward and form the retainer surfaces for the shell segments.

5. The turbine rotor blade of claim 2, and further comprising:

the spar includes a plurality of radial extending projections each having a row of cavities extending in the spanwise direction of the blade, and each forming a retainer occupying space to secure the shell segments to the spar.

6. The turbine rotor blade of claim 1, and further comprising:

the retainer forms a single piece that extends along substantially the entire spanwise length of the shell.

7. The turbine rotor blade of claim 1, and further comprising:

the spar includes a forward radial extending projection with a row of cavities on a forward side and an aft side of the forward radial extending projection;

the spar includes an aft radial extending projection with a row of cavities on a forward side and an aft side of the aft radial extending projection;

a forward set of shell ribs associated with the cavities on the forward side of the forward projection;

a middle set of shell ribs associated with the cavities on the aft side of the forward projection and the forward side of the aft projection;

an aft set of shell ribs associated with the cavities on the aft side of the aft projection; and, a forward retainer, a middle retain and an aft retainer each securing the shell to the spar by occupying a space formed by the cavities.

8. The turbine rotor blade of claim 1, and further comprising:

the retainer a bicast material or a transient liquid phase bonding material, or a sintered metal.

9. The turbine rotor blade of claim 1, and further comprising:

the retainer is a transient liquid phase bonding material; and, the spar cavity is coated with a stop-off agent to prevent the retainer from bonding to the spar for ease of removal.

10. The turbine rotor blade of claim 7, and further comprising:

the retainer a bicast material or a transient liquid phase bonding material, or a sintered metal.

11. The turbine rotor blade of claim 1, and further comprising:

the retainer is a transient liquid phase bonding material; and, the spar cavities are coated with a stop-off agent to prevent the retainer from bonding to the spar for ease of removal.

12. The turbine rotor blade of claim 1, and further comprising:

the shell segments are each formed of Molybdenum or Niobium.

13. The turbine rotor blade of claim 12, and further comprising:

the shell segments are each a thin walled shell and is formed from a wire EDM process.

14. The turbine rotor blade of claim 1, and further comprising:

the shell segments each have substantially the same radial height.

15. The turbine rotor blade of claim 1, and further comprising:

the shell is formed from four shell segments.

16. The turbine rotor blade of claim 1, and further comprising:

each shell segment includes a leading edge and a trailing edge and a pressure side wall and a suction side wall both extending between the leading edge and the trailing edge.

* * * * *